United States Patent [19]

Wai-Kwan

[11] Patent Number: 4,892,999

[45] Date of Patent: Jan. 9, 1990

[54] CALCULATOR

[75] Inventor: Ho Wai-Kwan, Kwai Chung, Hong Kong

[73] Assignee: Leona Electronics Co., Ltd., Hong Kong

[21] Appl. No.: 219,138

[22] Filed: Jul. 15, 1988

[51] Int. Cl.[4] ..... G06C 5/02

[52] U.S. Cl. ..... 235/1 D; 235/1 R; 235/145 R; 200/5 A; 200/293; 206/565; 364/708

[58] Field of Search ..... 235/1 R, 1 D, 145 R, 235/145 A, 96; 200/5 A, 293, DIG. 41, 43; 340/365 R, 365 P; 361/385; 364/708; 206/559, 564, 565

[56] References Cited

U.S. PATENT DOCUMENTS

| | | | |
|---|---|---|---|
| 4,078,257 | 3/1978 | Bagley | 364/900 |
| 4,441,001 | 4/1984 | Miyano et al. | 235/145 R |
| 4,517,421 | 5/1985 | Margolin | 235/145 R |

*Primary Examiner*—B. R. Fuller

*Attorney, Agent, or Firm*—Browning, Bushman, Zamecki & Anderson

[57] ABSTRACT

A see-through calculator or memory device comprises a transparent base, a see-through printed circuit board and a transparent switch panel. Liquid is housed in a cavity in the base, formed by welding to the base a panel above a recess in the base.

20 Claims, 2 Drawing Sheets

CALCULATOR

FIELD OF THE INVENTION

The present invention relates to a calculator or memory device and in particular to a see-through calculator, that is a calculator having a body which is substantially transparent in the region of the switches for inputting information, i.e. characters or instructions into the calculator.

BACKGROUND

It is known to provide see-through calculators, that is calculators in which the keyboard is transparent.

SUMMARY OF THE INVENTION

The present invention provides a see-through calculator or memory device having a see-through body portion carrying indicia indicating the position of switches for inputting information into the calculator, wherein the body portion has a cavity which contains a liquid. Preferably, the liquid underlies the indicia when viewed by a user and more preferably is provided underneath circuitry of the calculator or memory device.

Other preferred features and advantages will be apparent from the following description and the accompanying claims.

DESCRIPTION OF A PREFERRED EMBODIMENT

Figure 1:
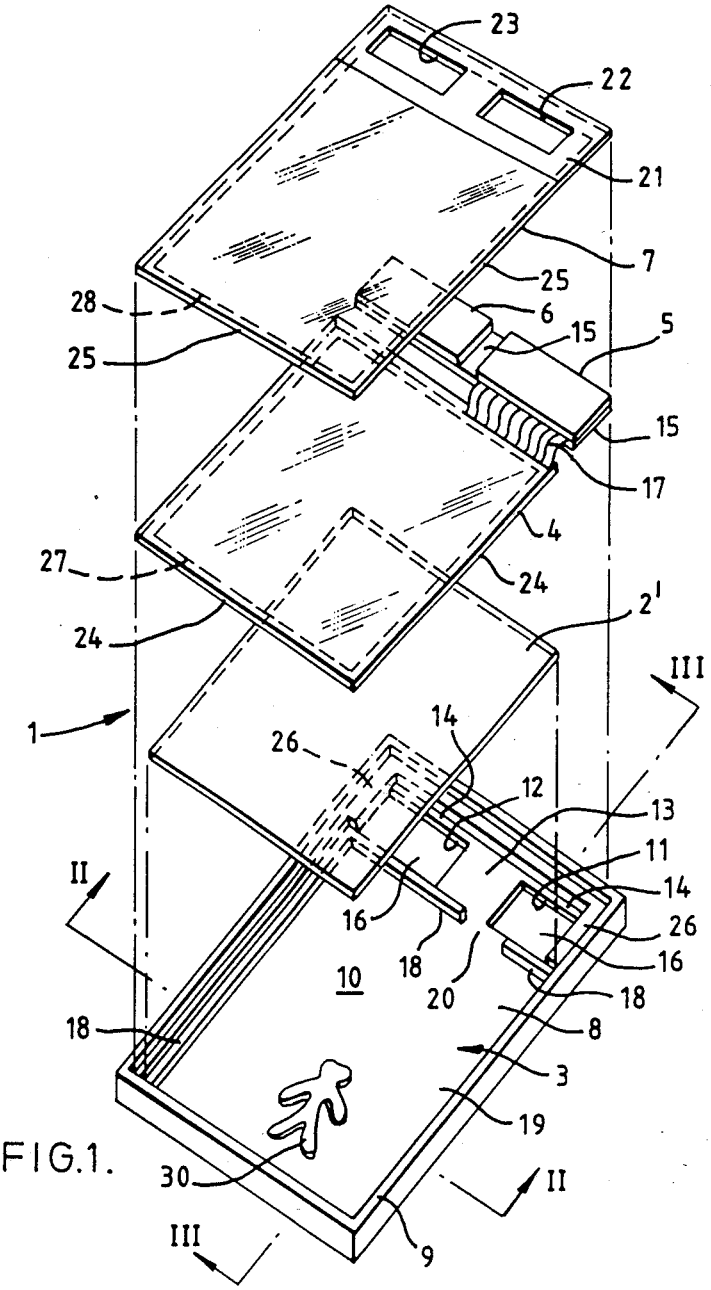
FIG. 1 is an exploded perspective view of a calculator according to the invention.

Referring to the drawings, a see-through calculator 1 embodying the invention comprises a transparent plastics tray 2, a transparent plastics panel 2', a transparent printed circuit board 4 with a solar cell 5 and a liquid crystal display 6, and a transparent switch panel 7. The construction of such calculators is well known in the art. The improvement provided by the present invention is the provision of liquid 3 in a cavity 19 formed between the panel 2' and tray 2, beneath the transparent circuit on the board 4.

Figure 2:
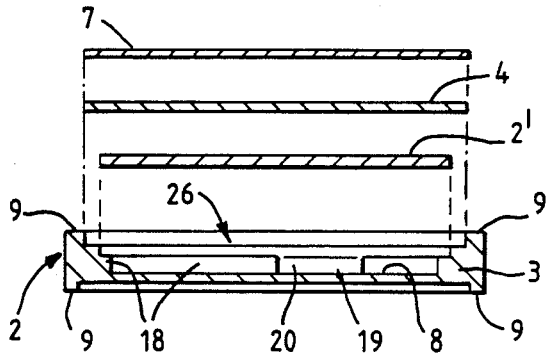
FIG. 2 is a cross-sectional view along the line II—II of FIG. 1.
Figure 3:
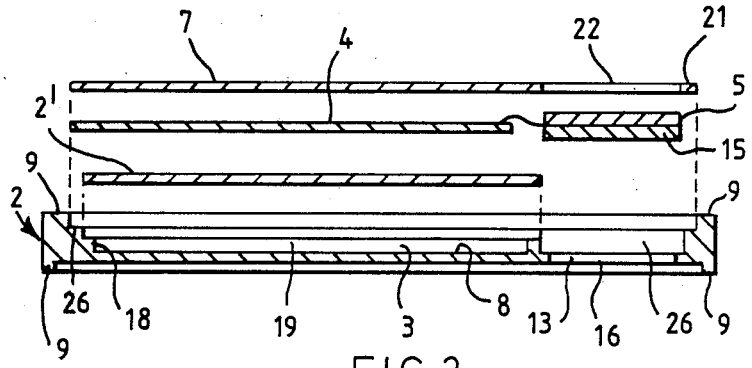
FIG. 3 is a cross-sectional view along the line III—III of FIG. 1.

More particularly, the transparent tray 2 is of plastics, such as polymethylmethacrylate, and comprises a base portion 8 with a rim 9 around its edge, extending upwardly and downwardly from the base 8 (see FIGS. 2 and 3). A shallow rectangular recess 19 is formed in the base 8 and this accommodates the liquid 3 which lays in the recess 19. The amount of liquid is preferably such that when the recess 19 is closed by the panel 2', thus forming cavity 10, there are both air and liquid in the cavity so formed.

A ledge 18 surrounds the recess 19 apart from a gap 20. The cavity panel 2' is attached to the ledge 18 by ultrasonic welding, forming the cavity 10 and a cavity opening at gap 20. The liquid 3 is then injected into the cavity through the opening 20 which is subsequently sealed with space-filling glue.

Also formed in the base 8 are two apertures 11, 12 separated by a web 13 and having a rim 14. Web 13 and rim 14 support a printed circuit board 15 which in turn carries the liquid crystal display 6 and the solar cell 5.

Apertures 11, 12 accommodate circuitry located on the underside of the board 15. An opaque plastics panel 16 is stuck to the underside of the tray 2, covering the apertures 11, 12.

The transparent circuit board 4 comprises a plastics panel having the transparent circuit printed on it, as is generally known in the art, and the circuit connects electrically with the board 15 via a heat seal connector 17. The transparent circuit comprises a plurality of pairs of conductors which are each arranged to be shorted by a respective switch on the switch panel 7. Switch panel 7 is of flexible transparent plastics and carries indicia, such as numerals or instructions, e.g. X, +, −, printed on its underside in opaque electrically conducting material. Also printed on the underside are pairs of dots, one pair associated with each indicia, which serve to space the indicia from the respective pair of conductors. Finger pressure on the top surface of the switch panel 7 above an indicia distorts the panel 7, to bring the indicia into contact with the underlying pair of conductors, shorting them and so providing a signal for the circuitry on board 15.

The transparent circuit board 4 is attached to the panel 2' by transparent double-sided adhesive tape 27 on its underneath along its side and bottom edges 24. The upper face of the board 4 is level with or just below the upper edge of the base 2. Panel 7 is then stuck on top of panel 4 by double-sided adhesive tape 28.

An opaque panel 21 is provided at the upper end of transparent switch panel 7. Opaque panel 21 has apertures 22, 23 which align with the liquid crystal display 6 and the solar cell 5.

The invention is equally applicable to electronic data storage devices, for example pocket electronic diaries as well as devices having a calculator function.

Two or more immiscible liquids may be provided, the liquids optionally filling the cavity 10. The liquid or liquids is(are) preferably coloured to enhance the visual effect. In the preferred embodiment, the liquid 3 comprises water and a water immiscible oil, which are tinted with different colour pigments. Objects, for example a toy diver 30, may be contained in the liquid, again to enhance the visual effect.

The term "see-through" calculator refers to the use of a transparent switch circuitry and board as is well known in the art.

The base 8 need not be transparent, although the visual effect may be enhanced if it is. A picture may be provided in register with the liquid, for example in the cavity, on the bottom of the recess, or on the underside of the circuit board. The picture may be transparent or translucent, again to enhance the visual effect.

Various modifications may be made to the described embodiment and it is desired to include all such modifications as fall within the scope of the accompanying claims.

What is claimed is:

1. A calculator or memory device, comprising:

a printed circuit board for performing memory functions;

a substantially transparent circuit board having a plurality of switches for inputting information to the printed circuit board;

a body external of the transparent circuit board and printed circuit board, the body including a substantially transparent keyboard-supporting member for supporting the transparent circuit board;

at least a portion of the keyboard-supporting member forming a hollow void between the transparent circuit board and the body; and a liquid in the hollow void of the portion of the keyboard-supporting member for enhancing visual effects.

2. A calculator or memory device as defined in claim 1, further comprising:

the hollow void defined by the portion of the keyboard-supporting member and the transparent circuit board and continuing the liquid is sealed from the plurality of switches;

each of the plurality of switches being pressure-sensitive switches; and the transparent circuit board includes first and second opposed substantially transparent sheets spaced from each other, each transparent sheet carrying electrically conductive switch contact patterns on a respective surface thereof, the electrically conductive switch contact patterns forming the plurality of pressure sensitive switches.

3. The calculator or memory device as defined in claim 2, wherein:

one of the first and second sheets is a transparent sheet carrying a first plurality of electrically conductive printed circuit switch contacts for forming each of said plurality of pressure sensitive switches; and the other of said first and second sheets is a flexible switch panel sheet carrying thereon electrically conductive indicia for short-circuiting respective pairs of said switch contacts when the flexible swtich panel sheet is subject to manual pressure.

4. The calculator or memory device as defined in claim 2, further comprising:

a cover panel positioned between the body and the transparent circuit board; and the hollow void defined by a recess in the portion of the keyboard-supporting member and a thermal surface of the cover panel between the body and the transparent circuit board.

5. The calculator or memory device as defined in claim 4, wherein both the cover panel and the portion of the keyboard-supporting member are formed of plastic and are welded together to form the hollow void.

6. A calculator or memory device as defined in claim 3, further comprising:

a cover panel positioned between the body and the transparent circuit board; and the hollow void defined by a recess in the portion of the keyboard-supporting member and a external surface of the cover panel between the body and the transparent circuit board.

7. A calculator or memory device as defined in claim 6, wherein both the cover panel and the portion of the keyboard-supporting member are formed of plastic and are welded together to form the hollow void.

8. A calculator or memory device as defined in claim 1, wherein the portion of the keyboard-supporting member houses the liquid.

9. A calculator or memory device as defined in claim 1, further comprising:

a solid object movable within the hollow void for enhancing visual effect.

10. A calculator or memory device as defined in claim 1, wherein the liquid is an immiscible liquid having selected color pigments for enhancing visual effects.

11. A calculator or memory device as defined in claim 5, further comprising:

a space filling substance for displacing the liquid into the hollow void, the space filling substance being in liquid form adaptable for injecting within the calculator or memory device to pass the liquid into the hollow void.

12. A calculator or memory device as defined in claim 1, further comprising:

a space filling substance for displacing the liquid into the hollow void, the space filling substance being in liquid form adaptable for injecting within the calculator or memory device to pass the liquid into the hollow void.

13. A calculator or memory device, comprising:

a printed circuit board for performing memory functions;

a substantially transparent circuit board having a plurality of switches for inputting information to the printed circuit board;

a body external of the transparent circuit board and including printed circuit board, the body including a substantially transparent keyboard-supporting member for supporting the transparent circuit board;

at least a portion of the keyboard-supporting member forming a hollow void between the transparent circuit board and the body;

the hollow void defined by the portion of the keyboard-supporting member and the transparent circuit board is sealed from the plurality of switches;

the transparent circuit board includes first and second opposed substantially transparent sheets spaced from each other, each transparent sheet carrying electrically conductive switch contact patterns on a respective surface thereof, the electrically conductive switch contact patterns forming the plurality of switches; and a liquid in the hollow void of the portion of the keyboard-supporting member for enhancing visual effects.

14. A calculator or memory device as defined in claim 13, wherein:

one of the first and second sheets is a transparent sheet carrying a first plurality of electrically conductive printed circuit switch contacts for forming each of said plurality of switches; and the other of said first and second sheets is a flexible switch panel sheet carrying thereon electrically conductive indicia for short-circuiting respective pairs of said switch contacts.

15. A calculator or memory device as defined in claim 13, further comprising:

a cover panel positioned between the body and the transparent circuit board; and the hollow void defined by a recess in the portion of the keyboard-supporting member and a external surface of the cover panel between the body and the transparent circuit board.

16. A calculator or memory device as defined in claim 14, wherein both the cover panel and the portion of the keyboard-supporting member are formed of plastic and are welded together 4 to form the hollow void.

17. A calculator or memory device as defined in claim 13, further comprising:

a cover panel positioned between the body and the transparent circuit board;

the hollow void defined by a recess in the portion of the keyboard-supporting member and a external surface of the cover panel between the body and the transparent circuit board; and both the cover panel and the portion of the keyboard-supporting member are formed of plastic and are welded together to form the hollow void.

18. A calculator or memory device as defined in claim 17, wherein the liquid is an immiscible liquid having selected color pigments for enhancing visual effects.

19. A calculator or memory device as defined in claim 13, further comprising:

a space filling substance for displacing the liquid into the hollow void, the space filling substance being in liquid form adaptable for injecting within the calculator or memory device to pass the liquid into the hollow void.

20. A memory device, comprising:

a printed circuit board for performing memory functions;

a substantially transparent circuit board having a plurality of switches for inputting information to the printed circuit board;

a body external of the transparent circuit board and including printed circuit board, the body including a substantially transparent keyboard-supporting member for supporting the transparent circuit board;

at least a potion of the keyboard-supporting member forming a hollow void between the transparent circuit board and the body;

the hollow void defined by the portion of the keyboard-supporting member and the transparent circuit board is sealed from the plurality of switches;

each of the plurality of switches being pressure-sensitive switches;

the transparent circuit board includes first and second opposed substantially transparent sheets spaced from each other, each transparent sheet carrying electrically conductive switch contact patterns on a respective surface thereof, the electrically conductive switch contact patterns forming a plurality of pressure sensitive switches;

a liquid in the hollow void of the portion of the keyboard-supporting member for enhancing visual effects, the liquid being an immiscible liquid having selected color pigments for enhancing visual effects; and a space filling substance for displacing the liquid into the hollow void.

* * * * *

UNITED STATES PATENT AND TRADEMARK OFFICE

CERTIFICATE OF CORRECTION

PATENT NO. : 4,892,999

DATED : January 9, 1990

INVENTOR(S) : Ho Wai-Kwan

It is certified that error appears in the above-identified patent and that said Letters Patent is hereby corrected as shown below:

In Column 3, line 11, delete "continuing" and insert therefor --containing--.

In Column 3, line 39, delete "thermal" and insert therefor --external--.

In Column 6, line 4, delete "potion" and insert therefor --portion--.

Signed and Sealed this

First Day of January, 1991

*Attest:*

HARRY F. MANBECK, JR.

*Attesting Officer*

*Commissioner of Patents and Trademarks*